US006887321B2

(12) United States Patent
Parkos, Jr. et al.

(10) Patent No.: US 6,887,321 B2
(45) Date of Patent: May 3, 2005

(54) CORROSION RESISTANT SURFACE TREATMENT FOR STRUCTURAL ADHESIVE BONDING TO METAL

(75) Inventors: Joseph J. Parkos, Jr., East Haddam, CT (US); Gary M. Lomasney, Glastonbury, CT (US); John W. Putnam, Glastonbury, CT (US); Mark R. Jaworowski, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 322 days.

(21) Appl. No.: 10/154,523

(22) Filed: May 22, 2002

(65) Prior Publication Data

US 2003/0217787 A1 Nov. 27, 2003

(51) Int. Cl.[7] ..... C23C 22/24

(52) U.S. Cl. ..... 148/264; 148/265; 148/267; 148/275; 148/276; 427/343

(58) Field of Search ..... 148/264, 265, 148/267, 275, 276; 427/343

(56) References Cited

U.S. PATENT DOCUMENTS

| | | | | |
|---|---|---|---|---|
| 4,085,012 | A | | 4/1978 | Marceau et al. |
| 4,127,451 | A | | 11/1978 | Marceau et al. |
| 5,304,257 | A | | 4/1994 | Pearlstein et al. |
| 5,374,347 | A | * | 12/1994 | Pearlstein et al. ..... 205/203 |

* cited by examiner

*Primary Examiner*—Roy King
*Assistant Examiner*—Lois Zheng
(74) *Attorney, Agent, or Firm*—Bachman & LaPointe, P.C.

(57) ABSTRACT

A metal substrate is anodized in a phosphoric acid anodizing solution. The anodized metal substrate is thereafter contacted with a hexavalent chromium free, trivalent chromium containing acid solution to coat the anodized metal substrate. The coated anodized metal substrate can be adhesively bonded to another such treated metal substrate to form a composite article. The resulting article exhibits excellent bonding and corrosion properties.

12 Claims, No Drawings

CORROSION RESISTANT SURFACE TREATMENT FOR STRUCTURAL ADHESIVE BONDING TO METAL

BACKGROUND OF THE INVENTION

This invention relates to preparing bonded, corrosion resistant coated, metal substrates which are resistant to delamination and free of hexavalent chromium in the corrosion resistant coating.

The structural bonding of metal to metal and composite type assemblies widely used in the aircraft industry and elsewhere frequently require a resultant structure which is reasonably resistant to the extremes of atmospheric conditions found in use. To avoid failures of the aircraft structures, bonded metal to metal and composite type assemblies must be able to withstand the environmental conditions to be encountered. Of particular importance is resistance to corrosion and delamination of composite structures. Heretofore, the adhesively bonded metal-to-metal and composite type assemblies (absent a chromated primer) have performed less than satisfactorily due to adhesive failure at the interface between the polymeric adhesive and the aluminum surface.

Conversion coatings have been widely used in metal surface treatment for improved corrosion inhibition. Conversion coatings are applied through chemical reactions between the metal and the bath solution which converts or modifies the metal surface into a thin film with required functional properties. Conversion coatings are particularly useful in surface treatment of metals such as steel, zinc, aluminum and magnesium. In the past, chromate conversion coatings have proven to be the most successful conversion coatings for aluminum and magnesium. However, chromate conversion coatings used in the past generally contained highly toxic hexavalent chromium. The use of hexavalent chromium results in potential hazardous working conditions for process operators and very high costs for waste disposal.

It is highly desirable to provide an improved process for preparing corrosion resistant, environmentally friendly, bonded metal substrates which are resistant to delamination.

SUMMARY OF THE INVENTION

The present invention provides a process for preparing metal substrates which are corrosion resistant, free of hexavalent chromium and satisfactorily bonded together with adhesives for functioning in aqueous, high temperature environments.

In accordance with the process of the present invention, a metal substrate is anodized in a phosphoric acid anodizing solution. The anodized metal substrate is thereafter contacted with a hexavalent chromium free, trivalent chromium containing acid coating solution to coat the anodized metal substrate. A non-chromated primer is applied and the coated anodized metal substrate can be adhesively bonded to another such treated metal substrate to form a composite article. The resulting article exhibits excellent bonding and corrosion properties.

DETAILED DESCRIPTION

The present invention provides for a multiple step process for treating metal substrates (preferably aluminum alloys) which are to be bonded together, for example by adhesive, to form a composite article.

The process comprises (1) anodizing the metal substrate in a phosphoric acid anodizing solution and (2) contacting the anodizing substrate with a hexavalent free, trivalent chromium containing acid coating solution to form a trivalent chromium containing coating of the anodized metal substrate.

The metal substrate may be subjected to a phosphoric acid anodize by any manner known in the prior art. Suitable methods for phosphoric acid anodizing are disclosed in U.S. Pat. Nos. 4,085,012 and 4,127,451, both of which are incorporated herein by reference. In accordance with the process of the present invention, the metal substrate, preferably aluminum alloy, is anodized in a phosphoric acid anodizing solution having phosphoric acid in a concentration of between 3% by weight to 20% by weight, at a temperature of between 50° F. to 85° F. at an anodizing potential of between 3 to 25 volts.

Once anodized, the substrates are contacted with an acidic trivalent chromium containing solution to form a trivalent containing corrosion coating on the metal substrate. The acidic aqueous solution comprises a water soluble trivalent chromium compound, a water soluble fluoride compound and an alkaline reagent. The trivalent chromium compound is present in the solution in an amount of between 0.2 g/liter to 5 g/liter (preferably between 0.5 g/liter to 2 g/liter), the fluoride compound is present in an amount of between 0.2 g/liter to 5 g/liter (preferably 0.5 g/liter to 2 g/liter), and the alkaline reagent is present in an amount to maintain the pH of the solution between 3.0 to 5.0 (preferably 3.5 to 4.0). A suitable solution is disclosed in U.S. Pat. No. 5,304,257 which patent is incorporated herein by reference. The metal substrates may be immersed in the solution, sprayed with the solution, painted with the solution etc. A suitable non-chromated primer is applied to the substrate thereafter.

Metal substrates processed in accordance with the present invention may then be adhesively bonded together, as is known in the art, to form a composite article. Suitable adhesives are well known in the prior art as are the method for applying to metal substrates and bonding. See again U.S. Pat. Nos. 4,085,012 and 4,127,451. Composite articles made in accordance with the present invention exhibit excellent bond strength and corrosion properties as evidenced by the following example.

EXAMPLE

Five wedge crack test specimens were prepared from adhesively bonded coupons of aluminum alloy 6061. Two 6"×6"×0.125" coupons were cleaned and dried. Thereafter the coupons were immersed in phosphoric acid and anodized under the following conditions:

Anodizing solution composition: 7.5% by volume phosphoric acid

Voltage: 15V

Temperature: Room Temperature

Time: 20 minutes

The phosphoric acid anodized coupons were thereafter received and dried. The coupons were immersed in a trivalent chromium coating solution under the following conditions:

Solution composition: 1 Part Chromium Compound;
1 Part Fluoride Compound; and
18 Parts Dionized Water Trivalent Chromium Compound: Chromium Sulfate Fluoride Compound: Potassium Fluorozirconate pH: 3.8

Temperature: Room Temperature

Time: 10 minutes immersion

Immediately after the trivalent chromium treatment the coupons were primed with a non-chrome filled version of BR6757-1 epoxy primer and cured at 350° F. for 90 minutes. Thereafter, the coupons were bonded together with Loctite Aerospace EA9689 nylon support film adhesive and cured at 350° F. under 60 psi of pressure for 2 hours. The bonded coupon was then cut into 5 wedge crack specimens, that were used to determine bond quality. The coupons were then tested according to ASTM D3762. The results are shown in Table I below.

TABLE I

| Sample # | Initial Crack Length (Inches) | Crack Growth In Inches After 1 hour | 2 hour | 4 hour | 24 hour | Failure Mode (% Cohesive) |
|---|---|---|---|---|---|---|
| 1 | 1.725 | 0.055 | 0.055 | 0.055 | 0.080 | 100 |
| 2 | 1.515 | 0.050 | 0.050 | 0.050 | 0.075 | 100 |
| 3 | 1.485 | 0.043 | 0.065 | 0.065 | 0.088 | 100 |
| 4 | 1.515 | 0.050 | 0.070 | 0.070 | 0.145 | 100 |
| 5 | 1.610 | 0.058 | 0.058 | 0.058 | 0.091 | 100 |
| average | 1.570 | 0.051 | 0.060 | 0.060 | 0.096 | 100 |

There are three failure mechanisms as follows.

C/A is cohesive in the adhesive. This is the preferred mode of failure. It indicates that the bond strength exceeded the strength of the adhesive. Failure occurred in the adhesive and not at the interface of either adhesive to primer or primer to metal.

A/P is adhesive to the primer. This mode of failure is indicative of interactions that may be occurring with the primer that may affect the bond strength of the adhesive to the primer. This mode is also used as a quality system check.

P/M is primer to metal. This is the mechanism that indicates that the process is not satisfactory.

As can be seen from Table I, all samples exhibited 100% C/A failure mode which indicates excellent bond strength. In addition, crack growth was comparable to standard crack growth rates and were acceptable.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for preparing a trivalent chromium coating on a metal substrate comprising the steps of:

(a) providing a phosphoric acid anodizing solution;

(b) anodizing a metal substrate in the phosphoric acid anodizing solution;

(c) providing a trivalent chromium containing acidic coating solution; and (d) contacting the anodized metal substrate with the acidic coating solution to form a trivalent chromium containing coating on the anodized metal substrate.

2. A process for preparing a trivalent chromium coating on a metal substrate comprising the steps of:

(a) providing a phosphoric acid anodizing solution;

(b) anodizing a metal substrate in the phosphoric acid anodizing solution;

(c) providing a trivalent chromium containing acidic coating solution wherein trivalent chromium containing acidic coating solution comprises a water soluble trivalent chromium compound, a water soluble fluoride compound and an alkaline reagent; and (d) contacting the anodized metal substrate with the acidic coating solution to form a trivalent chromium containing coating on the anodized metal substrate.

3. A process for preparing a trivalent chromium coating on a metal substrate comprising the steps of:

(a) providing a phosphoric acid anodizing solution;

(b) anodizing a metal substrate in the phosphoric acid anodizing solution;

(c) providing a trivalent chromium containing acidic coating solution;

(d) contacting the anodized metal substrate with the acidic coating solution to form a trivalent chromium containing coating on the anodized metal substrate; and (e) applying an adhesive to the coated, anodized metal substrate and bonding same to another coated, anodized metal substrate to form a composite article.

4. A process for preparing a trivalent chromium coating on a metal substrate comprising the steps of:

(a) providing a phosphoric acid anodizing solution;

(b) anodizing a metal substrate in the phosphoric acid anodizing solution;

(c) providing a trivalent chromium containing acidic coating solution wherein trivalent chromium containing acidic coating solution comprises a water soluble trivalent chromium compound, a water soluble fluoride compound and an alkaline reagent;

(d) contacting the anodized metal substrate with the acidic coating solution to form a trivalent chromium containing coating on the anodized metal substrate; and (e) applying an adhesive to the coated, anodized metal substrate and bonding same to another coated, anodized metal substrate to form a composite article.

5. A process according to one of claims 1, 2, 3 and 4, wherein the phosphoric acid anodizing solution has a phosphoric acid concentration of between 3% by weight to 20% by weight.

6. A process according to claim 5, wherein the anodizing potential is between 3 to 25 volts.

7. A process according to claim 6, wherein the anodizing is carried out at a temperature of between 50° F. to 85° F.

8. A process according to claim 5, wherein the pH of the acidic coating solution is between 3.0 and 5.0.

9. A process according to claim 5, wherein the pH of the acidic coating solution is between 3.5 to 4.5.

10. A process according to one of claims 1, 2, 3 and 4, wherein the metal substrate is an aluminum alloy.

11. A process according to one of claims 1, 2, 3 and 4, wherein the anodized metal substrate is immersed in the acidic coating solution.

12. A process according to one of claims 1, 2, 3 and 4, wherein the anodized metal substrate is sprayed with the acidic coating solution.

* * * * *